US008916773B2

(12) United States Patent
Mok et al.

(10) Patent No.: US 8,916,773 B2
(45) Date of Patent: Dec. 23, 2014

(54) HIGH CONDUCTIVITY WIRE AND METHOD OF MANUFACTURING THE SAME

(71) Applicants: Young Il Mok, Seoul (KR); Yeon Ho Choe, Seoul (KR); Chan-soo Choi, Daejeon (KR)

(72) Inventors: Young Il Mok, Seoul (KR); Yeon Ho Choe, Seoul (KR); Chan-soo Choi, Daejeon (KR)

( * ) Notice: Subject to any disclaimer, the term of this patent is extended or adjusted under 35 U.S.C. 154(b) by 0 days.

(21) Appl. No.: 13/899,408

(22) Filed: May 21, 2013

(65) Prior Publication Data

US 2013/0248223 A1 Sep. 26, 2013

Related U.S. Application Data

(63) Continuation of application No. 12/780,781, filed on May 14, 2010, now abandoned.

(30) Foreign Application Priority Data

Nov. 19, 2009 (KR) ..... 10-2009-0112151

(51) Int. Cl.
*H01B 7/00* (2006.01)
*H01B 5/10* (2006.01)
*H01B 13/02* (2006.01)

(52) U.S. Cl.
CPC ..... *H01B 7/0009* (2013.01); *H01B 5/10* (2013.01); *H01B 13/02* (2013.01)
USPC ..... 174/27; 174/36; 174/110 R; 174/113 R

(58) Field of Classification Search
USPC ..... 174/27, 113 C, 116, 131 A, 28, 36, 174/110 R, 113 R
See application file for complete search history.

(56) References Cited

U.S. PATENT DOCUMENTS

| | | | | | |
|---|---|---|---|---|---|
| 1,720,616 | A | * | 7/1929 | Werren | 379/415 |
| 1,841,486 | A | | 1/1932 | Legg | |
| 2,433,081 | A | * | 12/1947 | Wilkoff | 156/55 |
| 3,676,576 | A | | 7/1972 | Dubernet et al. | |
| 4,277,737 | A | * | 7/1981 | Muller-Werth | 320/127 |
| 4,336,420 | A | * | 6/1982 | Benz | 174/125.1 |
| 5,266,744 | A | * | 11/1993 | Fitzmaurice | 174/103 |
| 5,376,758 | A | * | 12/1994 | Kimber | 174/128.1 |
| 5,493,071 | A | * | 2/1996 | Newmoyer | 174/113 R |
| 5,745,628 | A | * | 4/1998 | Benzel et al. | 385/104 |
| 5,831,210 | A | * | 11/1998 | Nugent | 174/27 |
| 5,834,699 | A | * | 11/1998 | Buck et al. | 174/113 R |

(Continued)

FOREIGN PATENT DOCUMENTS

| | | | |
|---|---|---|---|
| DE | 546918 | C | 3/1932 |
| DE | 1019727 | B | 11/1957 |

(Continued)

OTHER PUBLICATIONS

Office Action in German Patent Application No. 10 2010 016 901.3, mailed Feb. 27, 2014.

(Continued)

*Primary Examiner* — William H Mayo, III
(74) *Attorney, Agent, or Firm* — Nixon Peabody LLP

(57) ABSTRACT

A high conductivity wire and a method of manufacturing the same are described wherein the high conductivity wire includes three or more conducting wires. In the method, conducting wires cross each other and are coiled regularly and three dimensionally. The conducting wires are coated with an insulating material.

12 Claims, 6 Drawing Sheets

(56) References Cited

U.S. PATENT DOCUMENTS

| | | | | |
|---|---|---|---|---|
| 5,880,402 | A * | 3/1999 | Nugent | 174/27 |
| 6,103,976 | A | 8/2000 | Kobayashi et al. | |
| 6,242,689 | B1 * | 6/2001 | Budge | 174/27 |
| 6,388,188 | B1 * | 5/2002 | Harrison | 174/27 |
| 6,974,906 | B2 * | 12/2005 | Lo | 174/36 |
| 7,019,218 | B2 * | 3/2006 | Somers et al. | 174/113 R |
| 7,021,961 | B1 * | 4/2006 | Soderholm | 439/505 |
| 8,222,767 | B2 * | 7/2012 | Fornage | 307/82 |
| 2001/0023755 | A1 * | 9/2001 | Kono | 164/113 |
| 2005/0045367 | A1 | 3/2005 | Somers et al. | |
| 2005/0103519 | A1 | 5/2005 | Brandsberg et al. | |
| 2009/0242272 | A1 * | 10/2009 | Little et al. | 174/72 A |

FOREIGN PATENT DOCUMENTS

| | | | |
|---|---|---|---|
| DE | 2051620 | A1 | 4/1972 |
| DE | 7908574 | U1 | 10/1979 |
| DE | 9306124.2 | U1 | 7/1993 |
| DE | 29516904 | U1 | 3/1996 |
| DE | 19703390 | A1 | 5/1998 |
| DE | 19833180 | A1 | 2/2000 |
| DE | 69723572 | | 4/2004 |
| DE | 102005062714 | A1 | 7/2007 |
| EP | 0256841 | | 2/1988 |
| EP | 0593043 | A1 | 4/1994 |
| FR | 2625599 | | 12/1987 |
| JP | 2007-200783 | | 8/2007 |
| WO | 98/20505 | A1 | 5/1998 |

OTHER PUBLICATIONS

Office Action in Chinese Patent Application No. 201010179875.4, mailed Feb. 19, 2014.

Office Action in U.S. Appl. No. 12/780,781, mailed Jun. 29, 2012.

Office Action in U.S. Appl. No. 12/780,781, mailed Mar. 21, 2013.

International Search Report in International Application No. PCT/CA97/00820, mailed on Feb. 5, 1998.

* cited by examiner

HIGH CONDUCTIVITY WIRE AND METHOD OF MANUFACTURING THE SAME

CROSS-REFERENCE TO RELATED PATENT APPLICATION

The present application is a continuation of U.S. patent application Ser. No. 12/780,781, filed May 14, 2010, which claims the benefit of Korean Patent Application No. 10-2009-0112151, filed on Nov. 19, 2009, in the Korean Intellectual Property Office, the disclosure of which is incorporated herein in its entirety by reference.

BACKGROUND OF THE INVENTION

1. Field of the Invention

The present invention relates to a high conductivity wire having improved electrical conductivity and a method of manufacturing the same.

2. Description of the Related Art

Any type of energy to be used by consumers goes through several stages including generation or collection, transportation, storage, transformation or conversion into a more convenient form, and usage. When passing from one phase to another phase, energy loss from several percents to several tens of percents may inevitably occur. According to the entropy law, energy gradually changes into an unusable low-quality form (e.g., heat) to scatter into space, which causes energy loss and environmental pollution.

Electrical energy is also lost during generation, conversion, and transmission from one point to another in space, the minimization of which is very important in terms of cost reduction and environment protection.

Electrical conductivity is a factor in the transmission of electrical energy. Electrical conductivity is a measure of the ability of an electrical conductor (e.g., an electric wire) to conduct an electric current. If electrical conductivity is high, an electric current flows well; whereas if electrical conductivity is low, an electric current flows poorly. Electrical conductivity may be expressed as the reciprocal of electrical resistance. Thus, electrical conductivity L of an electrical conductor may be expressed as the following equation:

$$L = \frac{1}{R} = \frac{S}{\rho l}$$

As can be seen from the above equation, the electrical conductivity L of an electrical conductor depends on a length l, a sectional area S, and an electrical resistivity ρ of the electrical conductor.

Superconduction is an example of a phenomenon that causes a change in the electrical resistivity ρ. superconduction is a phenomenon in which the electrical resistance of a metal or alloy becomes zero when the metal or alloy is cooled to a temperature close to 0K (−273.16° C.). Recently, extensive research is being conducted on the superconduction phenomenon. In particular, extensive research is being conducted on superconduction materials that may superconduct at relatively high temperatures, a superconduction phenomenon generated by conductors with relatively high critical temperatures, etc. However, the superconduction materials have many limitations in widespread use because they still have to be cooled to relatively low temperatures in order to show a superconduction phenomenon.

On the other hand, the electrical conductivity of a conducting wire may be affected by the length or thickness of the conducting wire. However, the electrical conductivity of a conducting wire is unable to be changed after fabrication of the conducting wire.

SUMMARY OF THE INVENTION

The present invention provides a high conductivity electric wire and a method of manufacturing the same, having high electrical conductivity while using a conventional conducting wire.

According to an aspect of the present invention, there is provided a method of manufacturing a high conductivity wire including three or more conducting wires, the method including: forming conducting wires crossing each other and coiled regularly and three dimensionally; and coating the conducting wires with an insulating material.

The conducting wires may include at least one dummy wire in which a current does not flow.

The dummy wire may be formed of a conductor, an insulator, a semiconductor, or a flammable material.

When the dummy wire is formed of a flammable material, the dummy wire may be removed by burning the flammable material.

The conducting wires may have different thicknesses.

According to another aspect of the present invention, there is provided a high conductivity wire including the conducting wires formed using any of the above methods.

According to still another aspect of the present invention, there is provided a high conductivity wire including: a plurality of base axis wires including conducting wires parallelly spaced from each other; and a plurality of additional conducting wires crossing each other and regularly and three-dimensionally coiled around the plurality of base axis wires.

The base axis wires may be spaced from each other within an interval about twenty times a thickness of the conducting wire forming the base axis wires.

When the number of base axis wires and additional conducting wires is three or more, cross sections of the base axis wires and the additional conducting wires in the high conductivity wire may be arranged in a circular or polygonal pattern.

When the number of base axis wires and additional conducting wires is three or more, cross sections of the base axis wires and the additional conducting wires in the high conductivity wire may be arranged in a figure eight (∞) pattern.

The high conductivity wire may further include a coating material that covers the base axis wires and the additional conducting wires to maintain shapes of the base axis wires and the additional conducting wires.

The high conductivity wire may be applied to at least one of photovoltaic power generators, microbial power generators, and fuel cell power generators.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1A:
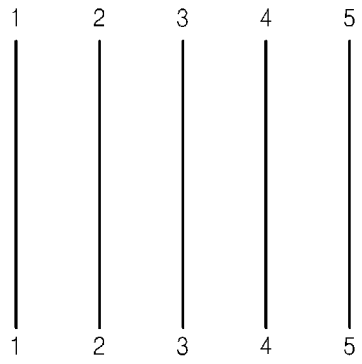
FIGS. 1A to 1F are views illustrating a process of manufacturing a high conductivity wire according to an embodiment of the present invention.
Figure 1B:
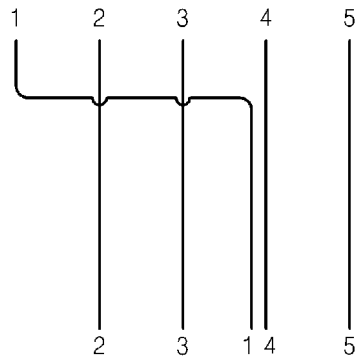
Figure 1C:
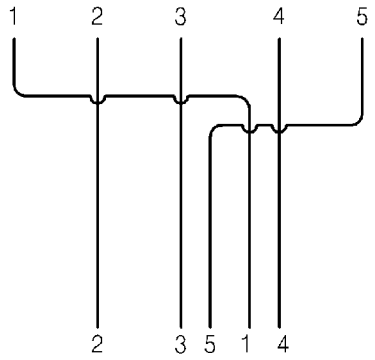
Figure 1D:
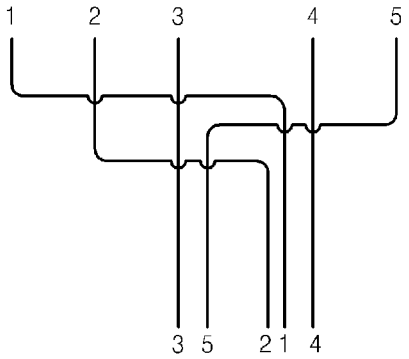
Figure 1E:
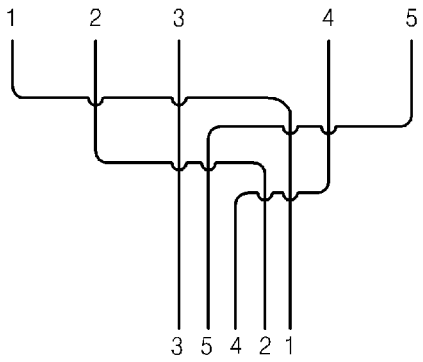

The present invention will now be described more fully with reference to the accompanying drawings, in which exemplary embodiments of the invention are shown. Hereinafter, for convenience of description, although one line through which current flows is referred to as a wire and a structure in which wires are coiled is referred to as an electric wire, the present invention is not limited thereto. Also, in the drawings, the thickness or size of each layer is exaggerated, omitted, or schematically illustrated for convenience of description and clarity.

Figure 2:
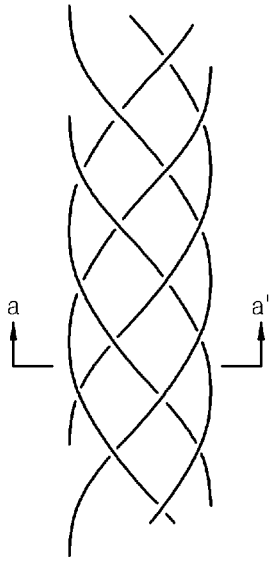
FIG. 2 is a view illustrating a configuration of an electric wire manufactured according to an embodiment of the present invention.
Figure 3:
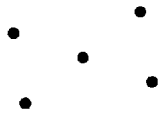
FIG. 3 is a sectional view taken along a line a-a' of FIG. 2.

FIGS. 1A to 1F are views illustrating a method of manufacturing a high conductivity electrical wire (hereinafter, referred to as an "electric wire") according to an embodiment of the present invention. FIG. 2 is a view illustrating a configuration of an electric wire manufactured according to an embodiment of the present invention. FIG. 3 is a sectional view taken along a line a-a' of FIG. 2. In the present embodiment, a method of manufacturing an electric wire by coiling five conducting wires will be described.

The five conducting wires according to the present embodiment may be arranged side by side. The conducting wires may each be a wire coated with an insulating material. For example, one or more of the conducting wires, e.g., a conducting wire 3, may be a dummy wire in which a current does not flow. Also, a conducting wire 1 and a conducting wire 2 at the left side of FIG. 1A may be positive (+) wires, and a conducting wire 4 and a conducting wire 5 at the right side of FIG. 1A may be negative (−) wires.

The conducting wires may be formed of a metal such as copper, silver, gold, or aluminum or an alloy thereof. A dummy wire may be formed of a conductor, an insulator, a semiconductor, or a flammable material. When a dummy wire is formed of a flammable material, the flammable material may also be burnt to remove the dummy wire. The conducting wires may each have the same or different thicknesses.

A method of coiling the five conducting wires may be as follows.

First, the leftmost conducting wire 1 may be passed over the conducting wires 2 and 3 and disposed between the conducting wires 3 and 4.

Second, the rightmost conducting wire 5 may be passed over the conducting wires 4 and 1 and disposed between the conducting wires 3 and 1.

Third, the leftmost conducting wire 2 may be passed over the conducting wires 3 and 5 and disposed between the conducting wires 5 and 1.

Fourth, the rightmost conducting wire 4 may be passed over the conducting wires 1 and 2 and disposed between the conducting wires 2 and 5.

Fifth, the leftmost conducting wire 3 may be passed over the conducting wires 5 and 4 and disposed between the conducting wires 4 and 2.

That is, the process described above repeats operations of positioning either rightmost or leftmost conducting wire at the center of the other four conducting wires.

Figure 1F:
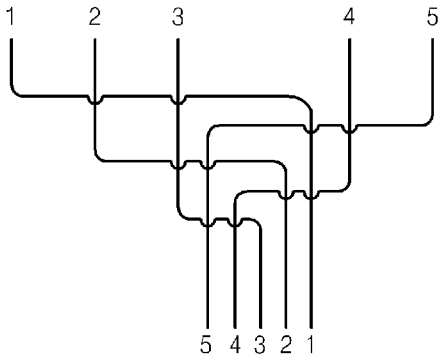

When the conductive wires are coiled according to the method described above, the conducting wires are arranged in the decreasing order of 5, 4, 3, 2, and 1 from the left side as shown in FIG. 1F. That is, the order of the conductive wires reversed.

When repeating the process again, the conducting wires may be arranged in the increasing order of 1, 2, 3, 4, and 5, which is the initial arrangement order. That is, by coiling the conducting wires as described above, the plurality of conducting wires may have a regularly coiled shape as shown in FIG. 2, and the plurality of conducting wires have a three-dimensionally coiled shape as shown in FIG. 3. The arrangement of the conducting wires may be periodically repeated by the regular coil. In the formation of the coiled shape, the conducting wires may be formed to cross each other. Here, FIG. 3 illustrates a cross section taken along the line a-a' of FIG. 2, but embodiments are not limited to the shape of the cross section of FIG. 3. That is, the shape of the cross section may vary with the location of the cross section.

The present embodiment has been described as including a dummy wire, but embodiments are not limited thereto. For example, the electric wire may also be formed of only conducting wires in which currents flow. Even when the electric wire includes a dummy wire, the dummy wire may be removed later.

On the other hand, terminals at both ends of the electric wire may include a positive terminal and a negative terminal. In the present embodiment, the positive terminal and the negative terminal may include two conducting wires, respectively. The number of conducting wires included in the respective terminals may vary with the number of conducting wires included in the electric wire. However, the number of conducting wires included in each terminal has to be equal to each other. When the number of conducting wires included in the electric wire is odd, the number of the dummy wires may be odd.

As described above, five conducting wires have been three-dimensionally coiled in various shapes, but the present invention is not limited thereto, and three or more conducting wires may be three-dimensionally coiled. Also, the coiled conducting wires may maintain a constant distance from each other while they cross each other. Thus, the electrical conductivity of the electric wire may be increased, and the resistance thereof may be reduced, thereby maximizing the efficiency of power transmission.

Experimental data of conductivity measured by using an electric wire having a high electrical conductivity according to an embodiment of the present invention is described in Table 1.

TABLE 1

| Input | 2 mm copper wire (single wire) | 2 mm copper wire (four wires) | Wire according to an embodiment (2 mm copper wire, five wires (one dummy)) |
|---|---|---|---|
| 12 V | 2.3 A, 27.6 W | 12 A, 144 W | 14.3 A, 171.6 W |
| 24 V | 2.9 A, 69.6 W | 12.4 A, 297.6 W | 15.2 A, 364.8 W |

The data measurement has been performed using a digital multimeter from Rhode & Schwarts Inc.

The following were all performed under the same conditions. When a voltage of about 12V was applied to an input terminal of a copper wire having a diameter of about 2 mm, a current of about 2.3 A flowed in the copper wire. When there were four strands of copper wires, a current of about 12 A flowed therethrough. On the other hand, when an electric wire according to an embodiment of the present invention was applied 12V, a current of about 14.3 A flowed therethrough. According to the present embodiment, five strands of wires may be used, and one of the five strands of wires may be a dummy wire in which a current does not flow. The dummy wire may be used to adjust the interval between the wires.

When a voltage of about 24V was applied to the input terminal of the copper wire having a diameter of about 2 mm, a current of about 2.9 A flowed therethrough. When there were four strands of copper wires, a current of about 12.4 A, about four times greater than 2.9 A, flowed. On the other hand, when the electric wire according to an embodiment of the present invention was applied 24V, a current of about 15.2 A flowed therethrough. All of the electric wires used herein were coated electric wires. The terminal included two input terminals and two output terminals, respectively. The terminals were made by binding two of four electric wires, respectively.

As shown in Table 1, when an electric wire according to an embodiment of the present invention is used, the electrical conductivity may be greater by about 19% to about 21% compared to a conventional method.

As described above, when an electric wire according to an embodiment of the present invention is used, the electrical conductivity of the electric wire may be increased. Accordingly, a current may flow more easily, and power consumed in the electric wire may be reduced due to a low resistance, thereby enabling more efficient power transmission.

Although the electric wire has been described as being formed by coiling five conducting wires, the embodiments are not limited thereto. That is, the number of conducting wires and the number of dummy wires included therein may be variously modified.

Figure 4:
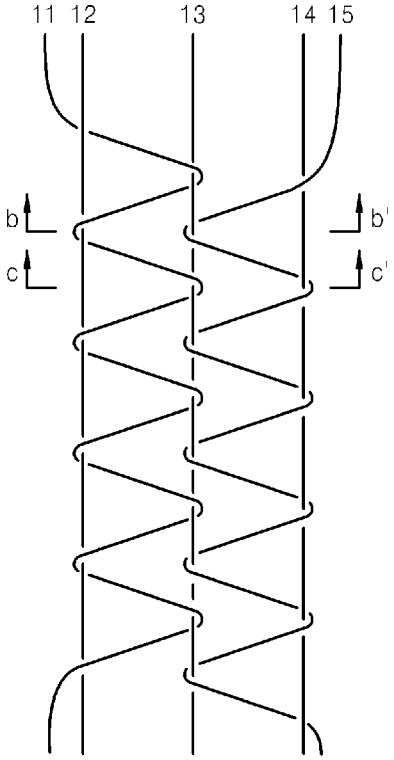
FIG. 4 is a view illustrating a configuration of a wire manufactured according to another embodiment of the present invention.
Figure 5A:
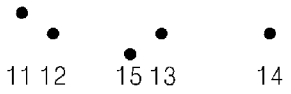
FIG. 5A is a sectional view taken along a line b-b' of FIG. 4.
Figure 5B:
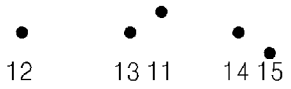
FIG. 5B is a sectional view taken along a line c-c' of FIG. 4.

FIG. 4 is a view illustrating a configuration of a wire manufactured according to another embodiment of the present invention. FIGS. 5A and 5B are sectional views taken along lines b-b' and c-c' of FIG. 4.

Referring to FIG. 4, the electric wire according to the present embodiment may include three conducting wires (hereinafter, referred to as "base axis wires") 12 to 14. The electric wire may further include two conducting wires 11 and 15 in a certain pattern.

The three base axis wires 12 to 14 may be spaced apart from each other by certain distances. The base axis wires 12 to 14 of FIG. 4 have been shown as being arranged on a straight line, but may be three-dimensionally arranged. For example, the cross sections of the base axis wires 12 to 14 may also have a polygonal shape such as triangle.

The distances between the base axis wires 12 to 14 may be within about twenty times the thickness of the base axis wires 12 to 14. The base axis wires 12 to 14 may be coated with an insulating material.

The two additional conducting wires 11 and 15 may be formed to have a three-dimensionally and regularly coiled pattern with respect to the base axis wires 12 to 14. In the present embodiment, the two additional conducting wires 11 and 15 may be formed to not cross each other, but embodiments are not limited thereto. The two additional conducting wires 11 and 15 may cross each other.

The additional conducting wires 11 and 15 may be formed of a metal such as copper, silver, gold, or aluminum or an alloy thereof. The additional conducting wires 11 and 15 may be coated with an insulating material.

Any of the base axis wires 12 to 14 or the additional conducting wires 11 and 15 may be a dummy wire. The dummy wire may be formed of a conductor, an insulator, a semiconductor, or a flammable material. When a dummy wire is formed of the flammable material, the flammable material may also be burnt to remove the dummy wire. The base axis wires 12 to 14 or the additional conducting wires 11 and 15 may have the same or different thicknesses.

Looking at the cross sections taken along the lines b-b' and c-c' of FIGS. 5A and 5B, the base axis wires 12 to 14 and the additional conducting wires 11 and 15 coiled therearound may be three-dimensionally arranged.

Although three base axis wires have been described as being provided in the present embodiment, the present invention is not limited thereto. For example, it is possible to form an electric wire using two or more base axis wires. Also, when there are three or more base axis wires, the base axis wires may be formed in a straight line or in a three-dimensional pattern. Here, the three-dimensional pattern means that cross sections of the base axis wires may have various patterns such as circle, oval, polygon, figure eight (∞), and peanut-shapes instead of a straight line.

Terminals at both ends of the electric wire may include two terminals, i.e., a positive (+) terminal and a negative (−) terminal. The terminals may include a base axis wire and a bundle of conducting wires coiled therearound. Each of the terminals may include half of all the conducting wires included in the electric wire. For example, when there are two base axis wires and two additional conducting wires, the positive terminal may include a bundle of one base axis wire and one additional conducting wire, and the negative terminal may include a bundle of the other base axis and the other additional conducting wire. When there are three base axis wires and two additional conducting wires, the positive and negative terminals may each include one base axis wire and one additional conducting wire. The remaining base axis wire may be a dummy wire.

Also, when the formation of the base axis wires and the additional conducting wires coiled therearound is completed, the electric wire may be coated with plastic or rubber to maintain the shape of the electric wire.

The formation of the base axis wires and the additional conducting wires coiled therearound may increase the electrical conductivity of the electric wire, and may allow a current to flow in the electric wire more easily. That is, it is possible to reduce power consumed in the electric wire and to more efficiently transmit power by reducing the resistance of the electric wire.

The theoretical background of improvement of power transmission efficiency by coiling individual conducting wires in an electric wire is based on concepts such as Maxwell's equations, harmonics and power factor theories, presence of maximum allowable amount and saturation capacity of a transmission line according to a power generation source, and electromagnetic interactions of current-flowing wires.

Harmonics are periodically repeated waveforms, which may be reduced into a sine wave having a fundamental frequency and sine waves having frequencies of integer multiples of the fundamental frequency. In this case, the harmonics may refer to the sine waves not having the fundamental wave. For example, a wave having a frequency of an n-multiple of the fundamental frequency may be called an n-order harmonic. In case of sound, the harmonics may correspond to overtones, and may be used in electric vibrations, electromagnetic waves, and the like. The harmonics may also be called a second or third harmonic according to the multiples of the fundamental frequency. When a vibration is a modified wave, and not a sine wave, the vibration may include a harmonic. For example, the tones of musical instruments may vary with included harmonics.

A power factor indicates a ratio of active power to apparent power in an alternating current (AC) circuit. While electric power is expressed as the product of voltage and current in a direct current (DC) circuit, the product of current and Root Mean Square (RMS) does not necessarily become electric power in an AC circuit. In an AC circuit, the product of voltage and current is referred to as the apparent power. Electric power may be obtained by multiplying the apparent power by the power factor. This is because voltage and current of AC circuit are changed to sine waves and the phases of both sine waves may not necessarily match each other. The active power may be expressed as VI cos $\phi$, where $\phi$ is a difference of the phase angles, V is a voltage, and I is a current. Since the apparent power is VI, the power factor may be expressed as VI cos $\phi$/VI=cos $\phi$, the active power divided by the apparent power, and may be generally expressed as a percentage. If $\phi$=0, cos $\phi$equals to 1, representing the maximum amount of electric power. That is, the power factor ranges from 0 to 1. When electric energy is converted into thermal energy like with an electric heater or incandescent lamp, the power factor becomes 1. However, when a portion of a current flowing in an iron core from an AC power source generates magnetic flux to store energy magnetically like with a motor or transformer having an iron core, or when energy is electrostatically stored like with a condenser, the power factor may be reduced. A low power factor may be referred to as a bad power factor.

A current flows through an electric wire when electricity is generated. A magnetic field is generated around where the current flows. In an electric wire including a plurality of conducting wires, unlike with an electric wire including a single conducting wire, the conducting wires may be affected by magnetic fields generated by current flowing neighboring conducting wires. The flowing direction of the current, i.e., the direction of the conducting wires, may have an effect on the direction of the magnetic field, may also have an effect on currents flowing in other conducting wires, and more exactly, movement (e.g., movement velocity) of electric charges. This means that the phases of the currents flowing in the conducting wires are affected, resulting in variations of the power factor.

In other words, when the plurality of conducting wires is three-dimensionally coiled to form one electric wire, the interactions between magnetic fields generated in the respective conducting wires may facilitate movement of electric charge in the conducting wires, and thus increase the electrical conductivity.

On the other hand, the high conductivity wire according to an embodiment of the present invention may be more advantageously applied to photovoltaic power generators such as crystalline silicon solar cells, thin-film solar cells, dye-sensitized solar cells, and organic solar cells, microbial power generators, and fuel cell generators.

For example, when electric power generated by a photovoltaic power generator is transmitted to storage batteries through electric wires according to embodiments of the present invention, electricity generated at a solar cell side may be more efficiently transmitted to the storage batteries.

In a photovoltaic power generator, carriers generated by irradiation of sunlight on a p-n junction material may be stored. In this case, as the number of carriers increases in the p-n junction material due to irradiation of sunlight, generation efficiency of carriers is reduced. Accordingly, it is necessary to send generated carriers to the outside more quickly. However, the movement velocity, i.e., drift velocity of free electrons, of the carriers is very slow (e.g., moving about 1 m takes approximately 1 hour and 10 minutes). Accordingly, the electric wire according to an embodiment of the present invention is expected to accelerate movement of electrons according to the various theories described above, and thus increase power generation efficiency by quickly removing newly generated carriers in the p-n junction material.

The power generation fields described above are merely examples. Accordingly, the present invention may be applied to all power generation fields, the power generation efficiency of which may be improved by facilitating movement of electric charges.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing a high conductivity wire comprising three or more conducting wires, the method comprising:

forming conducting wires crossing each other and coiled regularly and three dimensionally; and coating the conducting wires with an insulating material, wherein each of the conducting wires comprises at least one dummy wire in which a current does not flow, and when the number of conducting wires is odd, the number of the dummy wires is odd, and when the number of conducting wires is even, the number of the dummy wires is even; and wherein the forming five conducting wires comprising:

disposing a first conducting wire, a second conducting wire, a third conducting wire, a fourth conducting wire, and a fifth conducting wire from the left side;

passing the first conducting wire over the second and the third conducting wire, and disposing between the third and the fourth conducting wire;

passing the fifth conducting wire over the fourth and the first conducting wire, disposing between the third and the first conducting wire;

passing the second conducting wire over the third and the fifth conducting wire, disposing between the fifth and the first conducting wire;

passing the fourth conducting wire over the first and the second conducting wire, disposing between the second and the fifth conducting wire;

passing the third conducting wire over the fifth and the fourth conducting wire, disposing between the fourth and the second conducting wire.

2. The method of claim 1, wherein the dummy wire is formed of a conductor, an insulator, a semiconductor, or a flammable material.

3. The method of claim 2, wherein, when the dummy wire is formed of a flammable material, the dummy wire is removed by burning the flammable material.

4. The method of claim 1, wherein the conducting wires have different thicknesses.

5. A high conductivity wire comprising the conducting wires formed using any of the methods of claims 1 to 4.

6. The high conductivity wire of claim 5, wherein the high conductivity wire is applied to at least one of photovoltaic power generators, microbial power generators, and fuel cell power generators.

7. A high conductivity wire, comprising:

a plurality of base axis wires parallelly spaced from each other;

at least one dummy wire in which a current does not flow; and a plurality of additional conducting wires crossing each other and regularly and three-dimensionally coiled around the plurality of base axis wires, wherein when the number of conducting wires, which includes the plurality of base axis wires, the at least one dummy wire, and the plurality of additional conducting wires, is odd the number of the dummy wires are odd, and when the number of conducting wires is even the number of the dummy wires are even; and wherein the order of the conducting wires is reversed between a first end of the conductivity wire and a second end of the conductivity wire.

8. The high conductivity wire of claim 7, wherein the base axis wires are spaced from each other within an interval about twenty times a thickness of the conducting wires forming the base axis wires.

9. The high conductivity wire of claim 7, wherein, when the number of base axis wires and additional conducting wires is three or more, cross sections of the base axis wires and the additional conducting wires in the high conductivity wire are arranged in a circular or polygonal pattern.

10. The high conductivity wire of claim 7, wherein, when the number of base axis wires and additional conducting wires is three or more, cross sections of the base axis wires and the additional conducting wires in the high conductivity wire are arranged in a figure eight (∞) pattern.

11. The high conductivity wire of claim 7, further comprising a coating material that covers the base axis wires and the additional conducting wires to maintain shapes of the base axis wires and the additional conducting wires.

12. The high conductivity wire of claim 7, wherein the high conductivity wire is applied to at least one of photovoltaic power generators, microbial power generators, and fuel cell power generators.

* * * * *